US008932187B1

(12) United States Patent
Vittone et al.

(10) Patent No.: US 8,932,187 B1
(45) Date of Patent: Jan. 13, 2015

(54) RESISTANCE EXERCISE APPARATUS

(76) Inventors: Larry W. Vittone, Hurley, WI (US); Suzanne R. Vittone, Hurley, WI (US)

( * ) Notice: Subject to any disclaimer, the term of this patent is extended or adjusted under 35 U.S.C. 154(b) by 159 days.

(21) Appl. No.: 13/614,552

(22) Filed: Sep. 13, 2012

(51) Int. Cl.
*A63B 21/062* (2006.01)
*A63B 21/22* (2006.01)
*A63B 21/04* (2006.01)

(52) U.S. Cl.
CPC ..... *A63B 21/0442* (2013.01); *A63B 21/062* (2013.01)
USPC ..... 482/98; 482/99; 482/110

(58) Field of Classification Search
USPC ..... 482/98, 92–94, 97, 51–52, 55–57, 482/62–65, 72, 110, 133, 135–137, 900
See application file for complete search history.

(56) References Cited

U.S. PATENT DOCUMENTS 5,882,281 A * 3/1999 Stearns et al. ..... 482/51
8,870,716 B2 * 10/2014 Murray et al. ..... 482/51

* cited by examiner

*Primary Examiner* — Oren Ginsberg
*Assistant Examiner* — Megan Anderson
(74) *Attorney, Agent, or Firm* — Luedeka Neely Group, P.C.

(57) ABSTRACT

A resistance exercise apparatus is disclosed including a weighted object, an elongate beam, a first engagement member, a second engagement member, a frame, a first bearing and a second bearing. The elongate beam extends in and through weighted object such that when the beam rotates about its lengthwise axis, the weighted object rotates with the beam. Proximal ends of the engagement members are connected to the beam and include a cavity defined and a slot. The frame includes support extensions supporting the bearings, the bearings allowing the beam to rotate along its lengthwise axis within the bearings.

17 Claims, 11 Drawing Sheets

RESISTANCE EXERCISE APPARATUS

FIELD

This disclosure relates to the field of exercise equipment. More particularly, this disclosure relates to exercise machines for exercise involving resistance features.

BACKGROUND

Exercise machine technology allows a user to use weights as resistance for exercising a particular muscle group. However, traditional weight resistance exercise machines may be limiting in both the range of motion and types of exercises that may be performed. Additionally, traditional weight machines may be constrained to provide an amount of resistance corresponding only to the amount of weight used.

What is needed, therefore, is an exercise apparatus that provides a wide range of exercises and configurations, and that allows additional resistance to be added using the momentum of a weighted object.

SUMMARY

The above and other needs are met by a resistance exercise apparatus including a weighted object, an elongate beam, a first engagement member, a second engagement member, a frame, a first bearing and a second bearing.

The weighted object includes an aperture through the center of the weighted object wherein the aperture includes a first cross-sectional shape. The elongate beam includes the first cross-sectional shape and extends in and through the aperture of the weighted object, wherein the weighted object is engaged with the beam so that when the beam rotates about its lengthwise axis, the weighted object rotates with the beam at substantially the same rotational speed as the beam along the same axis.

A proximal end of the first engagement member is connected to a first end of the beam, the first engagement member including a cavity defined from a distal end of the first engagement member, and a slot extending from the distal end of the first engagement member along a portion of an outer edge of the first engagement member. A proximal end of the second engagement member is connected to a second end of the beam, the second engagement member including a cavity defined from a distal end of the second engagement member, and a slot extending from the distal end of the second engagement member along a portion of an outer edge of the second engagement member.

The frame includes a first support extension and a second support extension wherein the first support extension is connected to the second support extension defining a space between the first support extension and the second support extension.

The first bearing is connected to a proximal end of the first support extension wherein a first portion of the beam located between the first engagement member and the weighted member is maintained within the first bearing, wherein the beam is free to rotate along its lengthwise axis within the first bearing. The second bearing is connected to a proximal end of the second support extension wherein a second portion of the beam located between the second engagement member and the weighted member is maintained within the second bearing, wherein the beam is free to rotate along its lengthwise axis within the first bearing, wherein the weighted member extends at least partially into the space between the first support extension and the second support extension.

In one embodiment, the first cross-sectional shape comprises a polygonal shape including from one substantially straight side to sixteen substantially straight sides. In another embodiment, the first cross-sectional shape comprises at least one curved side.

In yet another embodiment, the first engagement member further comprises a first engagement member port for receiving the first end of the beam and removably engaging with the beam such that the first engagement member rotates at substantially the same speed as the beam when the beam is rotated along its lengthwise axis, and wherein the second engagement member further comprises a second engagement member port for receiving the second end of the beam and removably engaging with the beam such that the second engagement member rotates at substantially the same speed as the beam when the beam is rotated along its lengthwise axis.

In one embodiment, the first bearing comprises a plain bearing and a second bearing comprises a plain bearing. In another embodiment, the first bearing comprises a rolling element bearing and the second bearing comprises a rolling element bearing, wherein each rolling element bearing includes an inner ring including an aperture configured in the first cross-sectional shape and sized to fit snug about the beam but still allowing the beam to be moved in and out the inner ring aperture as needed.

In another embodiment, the resistance apparatus further includes a first elastic band, a first handle connected to a proximal end of the first elastic band, and a first stopper connected proximate a distal end of the first elastic band, wherein the first stopper is configured for removable insertion within the cavity defined from a distal end of the first engagement member wherein the first elastic band extends out through the slot of the first engagement member but the size of the first stopper keeps the first stopper from escaping through the slot of the first engagement member, thereby maintaining a connection between the first elastic band and the first engagement member. The resistance apparatus also includes a second elastic band, a second handle connected to a proximal end of the second elastic band, and a second stopper connected proximate a distal end of the second elastic band, wherein the second stopper is configured for removable insertion within the cavity defined from a distal end of the second engagement member wherein the second elastic band extends out through the slot of the second engagement member but the size of the second stopper keeps the second stopper from escaping through the slot of the second engagement member, thereby maintaining a connection between the second elastic band and the second engagement member.

In one embodiment, the weight object further comprises a wheel. In another embodiment, the resistance apparatus further includes a first cord and a first stopper connected proximate a distal end of the first cord, wherein the first stopper is configured for removable insertion within the cavity defined from a distal end of the first engagement member wherein the first cord extends out through the slot of the first engagement member but the size of the first stopper prevents the first stopper from escaping through the slot of the first engagement member, thereby maintaining a connection between the first cord and the first engagement member.

In one embodiment, the frame further comprises a base on which the exercise apparatus is supported. In another embodiment, the exercise apparatus further includes an exercise bench including a support platform and a plurality of legs connected to the support platform, wherein the frame is connected to the exercise bench proximate a first end of the exercise bench.

In one embodiment, the weighted object is located beneath the support platform. In another embodiment, the exercise apparatus further includes a backrest plate connected to the support platform proximate the first end of the exercise bench.

In yet another embodiment, the exercise apparatus further includes a central structure, a first arm, and a second arm. The first arm is movably connected to the first column. The second arm is movably connected to the second column. The frame is connected to the central structure, wherein a proximal end of the first cord is connected proximate a lower end of the first arm and a proximal end of the second cord is connected proximate a lower end of the second arm, wherein tension along the first cord is generated when a user sitting on the seat pulls an upper portion of the first arm toward the user and wherein tension along the second cord is generated when a user sitting on the seat pulls an upper portion of the second arm toward the user.

In one embodiment, the first arm further comprises a first handgrip connected along the upper portion of the first arm; and wherein the second arm further comprises a handgrip connected along the upper portion of the second arm.

In another embodiment, the exercise apparatus further includes a first foot platform connected proximate the lower end of the first column and a second foot platform connected proximate the lower end of the second column, wherein tension along the first cord is generated when a user sitting on the seat pushes the first foot platform away from the user and wherein tension along the second cord is generated when a user sitting on the seat pushes the second foot platform away from the user.

In another aspect, embodiments of the disclosure provide a clamping device for attachment to a band, the clamping device including a first elongate slug including a first end and a second end, a second elongate slug including a first end and a second end, a first ovular-shaped ring including a threaded aperture located along a narrow end of the first elongate slug, a second ovular-shaped ring including a threated aperture located along a narrow end of the first elongate slug, a first elongate insert configured with reciprocating threads to engage with the threads of the aperture in the first ovular-shaped ring, and a second elongate insert configured with reciprocating threads to engage with the threads of the aperture in the second ovular-shaped ring. The clamping device can be tightly attached to a band by (i) placing the first elongate slug along a first surface of a band, (ii) placing the second elongate slug along a second surface of the elongate band, (iii) placing the first ovular-shaped ring about the first ends of the elongate slugs, (iv) placing the second ovular-shaped ring about the second ends of the ovular-shaped slugs, (v) rotating the first elongate insert further into and through the aperture of the first ovular-shaped ring, thereby pressing the elongate slugs closer together with the band therebetween proximate the first ends of the elongate slugs, and (vi) rotating the second elongate insert further into and through the aperture of the second ovular-shaped ring, thereby pressing the elongate slugs closer together with the band therebetween proximate the second ends of the elongate slugs.

In another aspect, embodiments of the disclosure provide a clamping device for attachment to a band, the clamping device including a first elongate slug including a first end and a second end, a second elongate slug including a first end and a second end, a first pair of clamps, each clamp including a pair of flanes wherein each flange includes an aperture therethrough, a second pair of clamps, each clamp including a pair of flanges wherein each flange includes an aperture therethrough, a first pair of fasteners for fastening the first pair of clamps together, and a second pair of fasteners for fastening the second pair of clamps together. The clamping device can be tightly attached to a band by (i) placing the first elongate slug along a first surface of a band, (ii) placing the second elongate slug along a second surface of the elongate band, (iii) placing the first pair of clamps about the respective first ends of the elongate slugs, (iv) placing the second pair of clamps about the respective second ends of the elongate slugs, (v) attaching and tightening the first clamps together using the first pair of fasteners, thereby pressing the elongate slugs closer together with the band therebetween proximate the first ends of the elongate slugs, and (vi) attaching and tightening the second clamps together using the second pair of fasteners thereby pressing the elongate slugs closer together with the band therebetween proximate the second ends of the elongate slugs.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

beam: A "beam" is defined herein as an elongate structure, preferably made of a metal, metal alloy, or composite material, and preferably having a consistent cross-sectional shape. The type of cross-sectional shape is not limited to any specific category of shapes.

cord: A "cord" is broadly defined herein as an elongate section of material (synthetic or natural) in the form of, for example, a rope, a band, a line, a cable, a wire, a chain, a tube or the like, whether elastic or inelastic, that has sufficient tensile strength to withstand a minimum of about 25 pounds-force per cross-sectional area of the cord itself.

elongate (adj.): the characteristic of an object wherein such object is longer than it is wide.

plain bearing: a "plain bearing" is a simple mechanical bearing including what are known to persons having ordinary skill in the art as a "plane bearing", a "friction bearing", a "journal bearing", a "bushing", or the like.

rolling element bearing: a "rolling element bearing" is broadly defined herein as any mechanical bearing in which one or more balls or rollers are used to prevent or minimize friction between surfaces.

stopper: a "stopper" is broadly defined herein as an apparatus connected to a cord to prevent the cord from escaping a slot or aperture defined in another structure.

Figure 1:
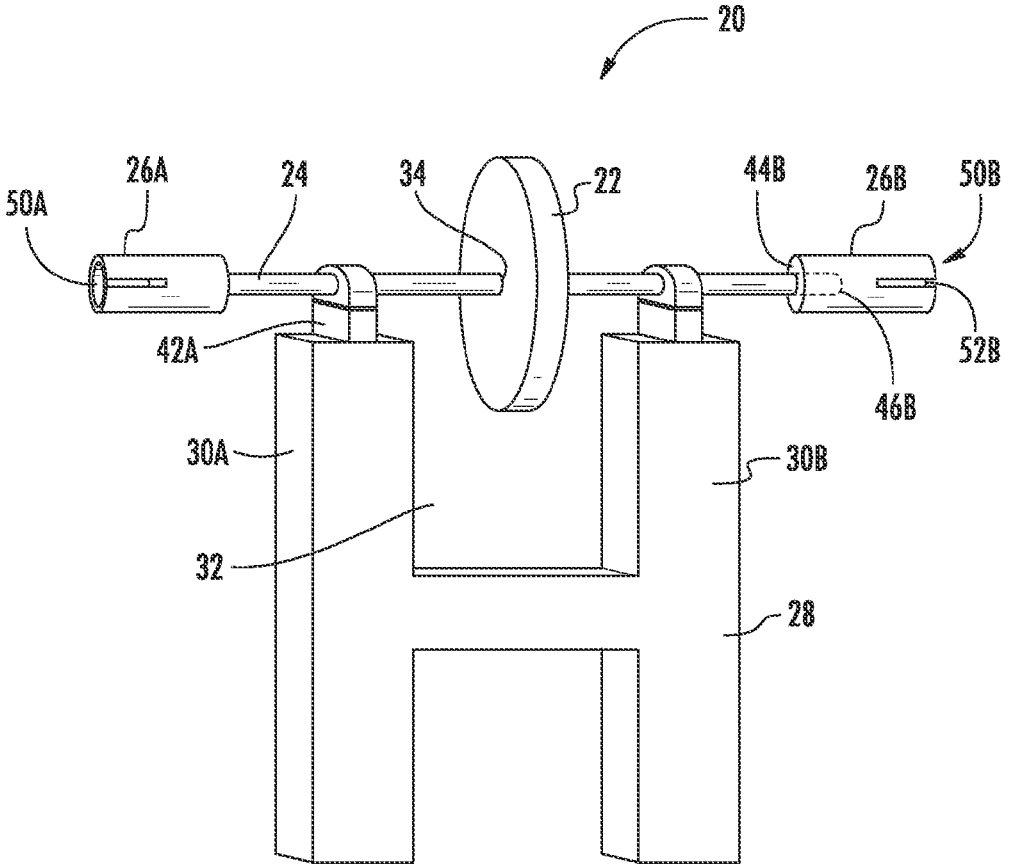
FIG. 1 shows a schematic front view of an exemplary exercise apparatus as described herein.

FIG. 1 shows resistance apparatus 20 for a resistance exercise device, the resistance apparatus 20 including a weighted object 22, an elongate beam 24, a first engagement member 26A, a second engagement member 26B, and a frame 28. The frame 28 includes a first support extension 30A and a second support extension 30B connected to one another wherein an extension space 32 is defined between the support extensions 30.

The weighted object 22 is preferably in the form of a wheel, but other shapes and various thicknesses are contemplated for the weighted object 22. The weight of the weighted object can vary from about 5 pounds to about 200 pounds, although from about 10 pounds to about 20 pound weighted objects have been shown to be very effective for many exercises. An aperture 34 is defined through the thickness and preferably at the center of the weighted object 22. The aperture 34 has a cross-sectional shape in the shape of, for example, a circle or a polygon. Preferably, the aperture 34 is in the form of a circle, an oval, a polygon having from two to sixteen sides, or a combination of straight and curved sides.

Figure 2:
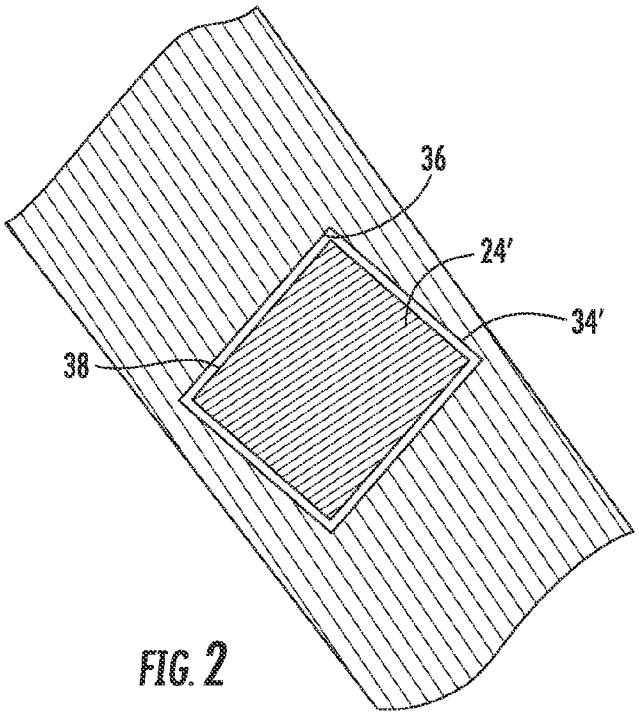
FIG. 2 shows a cross-sectional view of an elongate beam and a weighted object as described herein.

As shown in FIG. 2, the elongate beam 24' preferably has a cross-sectional shape the same as the cross sectional shape of the aperture 34' but slightly smaller so that the elongate beam 24' can be extended through the aperture 34' but with a close fit. Preferably, the greatest distance between an inner surface 36 of the weighted object 22 and a corresponding outer surface 38 of the elongate beam 24' should be no greater than about 2.5 millimeters and more preferably, no greater than about 1.5 millimeters. These preferred distances are important, particularly with regard to examples in which no other devices are used to rotationally fix the weighted object 22 relative to the elongate beam. For example, in the example in FIG. 2 in which the cross sectional shape of the aperture 34' and the elongate beam 24' is a four-sided polygon, in order for the rotation of the elongate beam to result in substantially equal rotation of the weighted object 22, the greatest distance between the inner surface 36 of the weighted object 22 and a corresponding outer surface 38 of the elongate beam 24' must be small enough so that the elongate beam 24' does not slip within the aperture 34', resulting in less than substantially equal rotation of the weighted object 22 as compared to the rotation of the elongate beam 24'.

Figure 3:
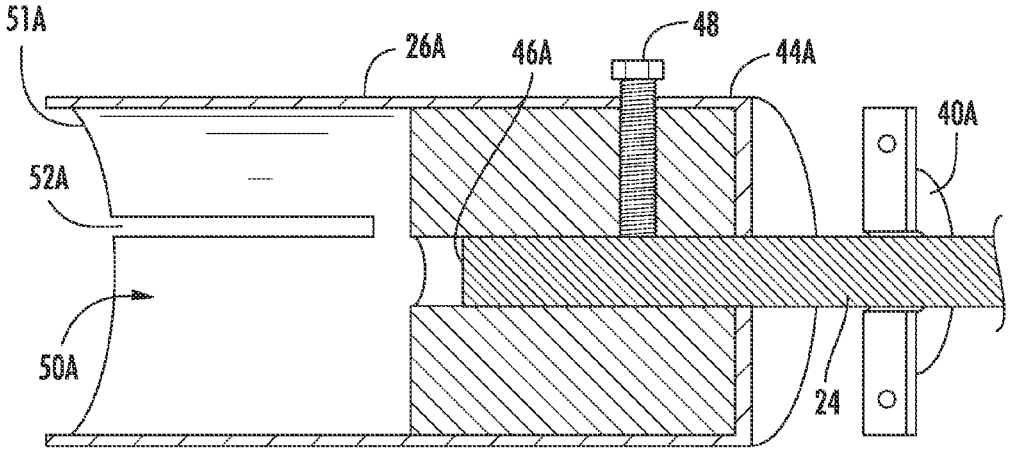
FIG. 3 shows a cross-sectional side view of an elongate beam and an engagement member as described herein.

FIG. 3 shows a cross-sectional view of the first engagement member 26A. The view in FIG. 3 also shows a portion of the elongate beam 24, and a first bearing 40A (e.g., an attachment collar) for connection to a first end 42A of the first support extension 30A in a position around the beam 24 to connect the beam 24 to the frame 28. A proximal end 44A of the first engagement member 26A is connected to a first end 46A of the elongate beam 24, for example, by a radial tightening screw 48. Although a radial tightening screw 48 is shown in FIG. 3, other devices for firmly connecting the beam 24 with the proximal end 44A of the first engagement member 26A are contemplated herein including, for example, the option of welding the first end 46A of the beam 24 to the proximal end 44 of the first engagement member 26A. In any event, this disclosure is not intended to be limited based on the manner in which the beam 24 is connected to the engagement members 26 as shown herein. Referring again to FIG. 1, the second engagement member 26B is preferably substantially identical to the first engagement member 26A, including the manner in which the second engagement member 26B connects with a second end 46B of the beam 24. A second bearing 40B is also located proximate the second engagement member 26B for connecting the beam 24 to the frame 28.

Figure 4:
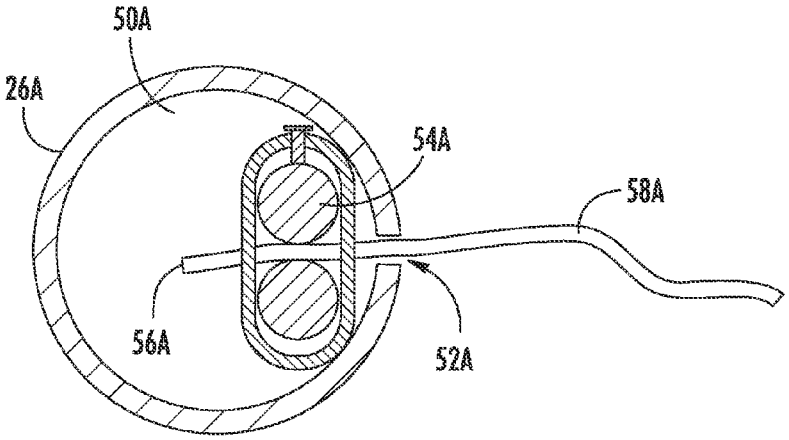
FIG. 4 shows a side view of a stopper, cord, and engagement member as described herein.
Figure 5:
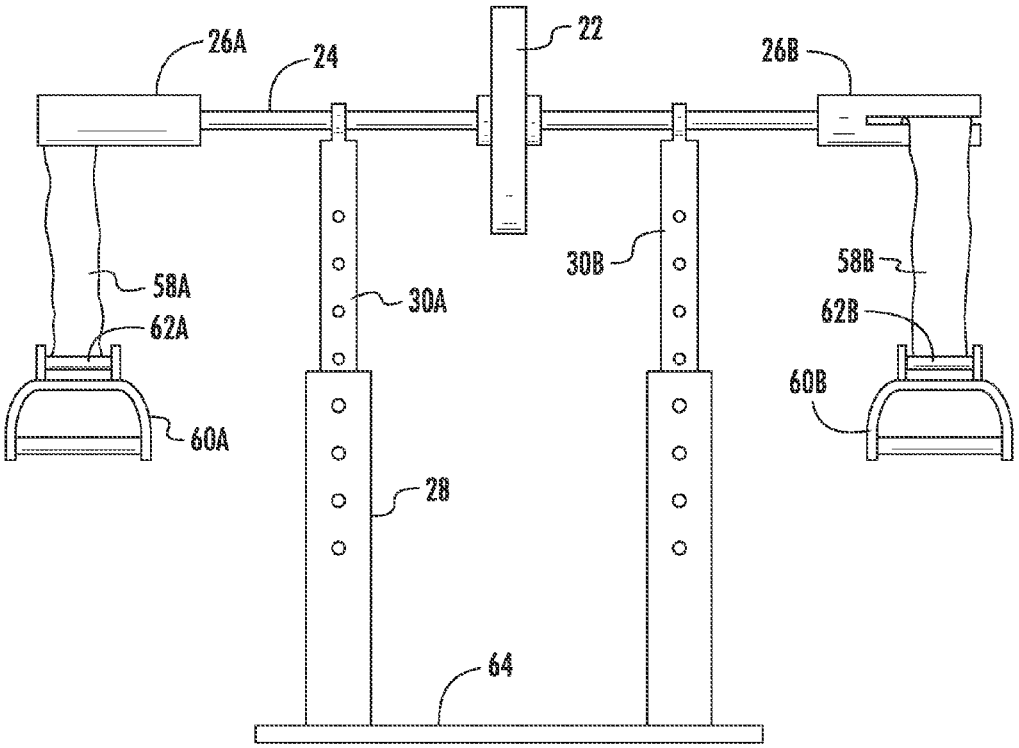
FIG. 5 shows a schematic front view of an exemplary exercise apparatus as described herein.

As shown in FIGS. 3-4, the first engagement member 26A includes a first cavity 50A defined from a distal end 51A of the first engagement member 26A. The first engagement member 26A further includes a first slot 52A extending from the distal end 51A of the first engagement member 26A for receiving a first stopper 54A. The first stopper 54A is shown connected proximate a distal end 56A of a first cord 58A wherein the first stopper 54A is configured to fit at least partially within the first cavity 50A but to not escape through the first slot 52A, thereby anchoring the first cord 58A at the first engagement member 26A. Preferably, a first handle 60A is connected a proximal end 62A of the first cord 58A (FIG. 5). The same structure is preferably mirrored on the opposing side with the second engagement member 26B including a second cavity 50B, a second slot 52B, a second stopper 54B, a second cord 58B, and a second handle 60B. Preferably, the cords 58 include an elastic band or elastic rope, but substantially inelastic ropes, bands, or other similar materials are contemplated.

The cords 58 are secured to the engagement members 26 by sliding the stoppers 54 into the slots 52 such that the stoppers 54 are positioned within the cavities 50 and thereby prevent the cords 58 from being removed from the engagement members 26. After securing the cords 58 to the engagement members 26, the beam 24 and engagement members 26 may be rotated either clockwise or counter-clockwise to wind the cords 58 around the engagement members 26. The beam 24 and engagement members 26 are preferably rotated until approximately half of the length of the cords 58 is wrapped around the engagement members 26.

The resistance apparatus 20 described herein can be used in many ways as a resistance component, either by itself or in tandem with additional hardware. After securing the cords 58 to the beam 24, when the proximal end 62A of the first cord 58A is drawn by a user, the beam 24 rotates which, in turn, causes the weighted object 22 to rotate. The momentum of the weighted object 22 and the beam 24 draws the proximal end 62B of the second cord 58B in an opposite direction compared to first cord 58, thereby creating increased resistance for a user with regard to the second cord 58B. Preferably, the first cord 58A and the second cord 58B are reciprocally drawn in a back and forth pattern wherein the user creates additional resistance for himself or herself based, at least in part, on how forceful he or she draws one cord before the next, whether through a pulling exercise, a pushing exercise, or otherwise. When the cords 58 are elastic, the transitions between reciprocal movements is smoother and more dynamic based on the dynamic stretching of each cord 58. For some exercises, it might be more desirable to use non-elastic cords, however. As such, both options are available, and different cords 58 of varying degrees of elasticity can be interchanged at will. The amount of resistance can be increased by, for example, adding a heaver or additional weighted object to the beam 24; switching out a first cord 58 of less elastic strength with a second cord having more elastic strength; and/or, if the cords 58 are elastic, decreasing the distance between the locations where the stoppers 54 and the handles 60 are connected along the respective cords 58, thereby causing the elastic cords 58 to be stretched more when in use.

The resistance apparatus 20 described herein can be used in different ways and with or without additional exercise equipment. For example, as shown in FIG. 5, the resistance apparatus 20 is shown wherein the frame 28 is connected to or otherwise further includes a base 64 to support the exercise apparatus 20 from the ground up, preferably at varying heights based on the type of exercise in which a user wants to engage.

Figure 6:
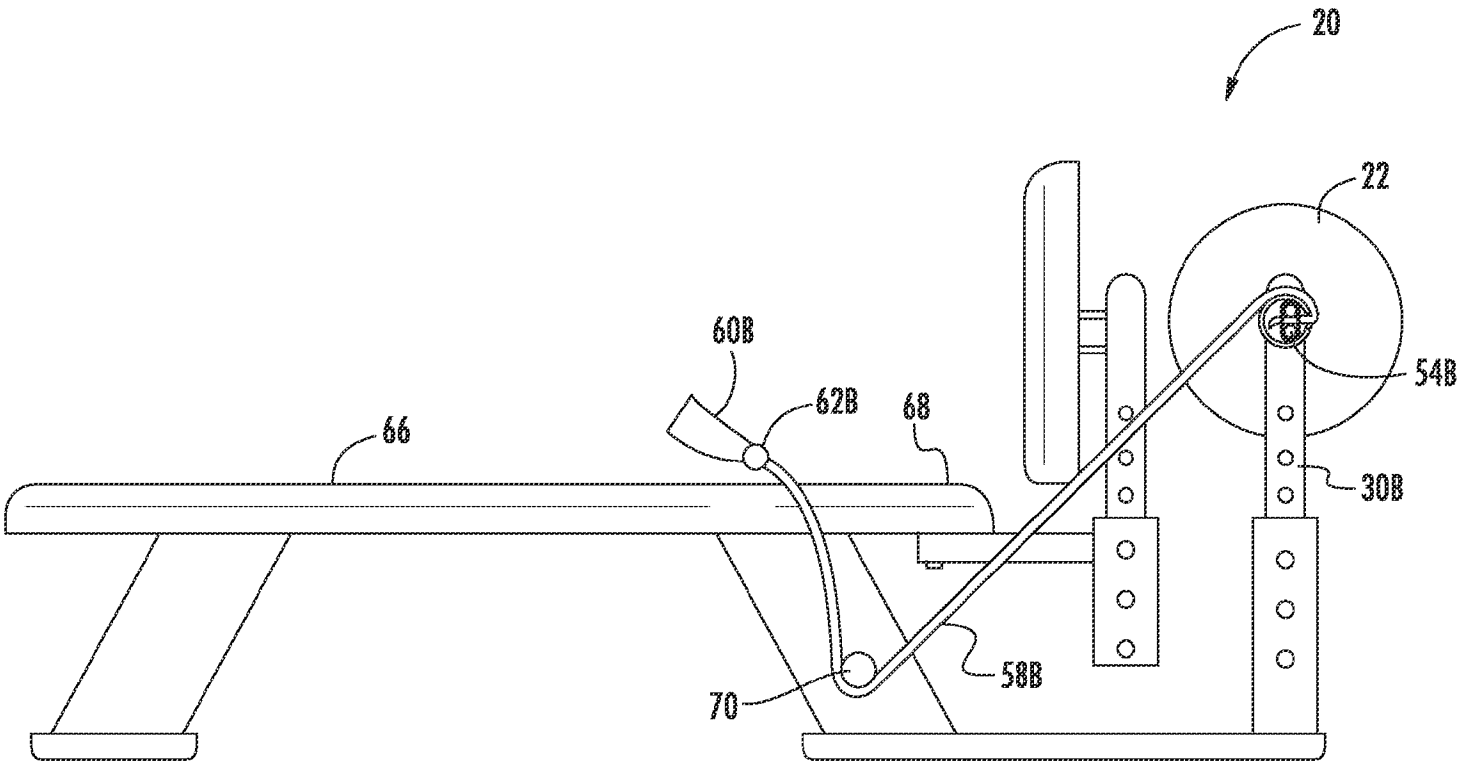
FIG. 6 shows a schematic side view of an exemplary exercise apparatus as described herein.

FIG. 6 shows an example in which the resistance apparatus 20 is connected to an exercise bench 66. In the example shown in FIG. 6, the resistance apparatus 20 is connected proximate a first end 68 of the bench 66. A pair of pivot members 70 are provided about which a user can wrap the respective cords 58 in order to experience exercise resistance from a location below the bench 66 allowing for lying bench press exercises or the like. The pivot members 70 can simply be static structures (e.g., bars) about which the cords 58 pivot partially around, or, for example, the pivot members 70 could be in the form of dynamic structures (e.g., pulley wheels).

Figure 7A:
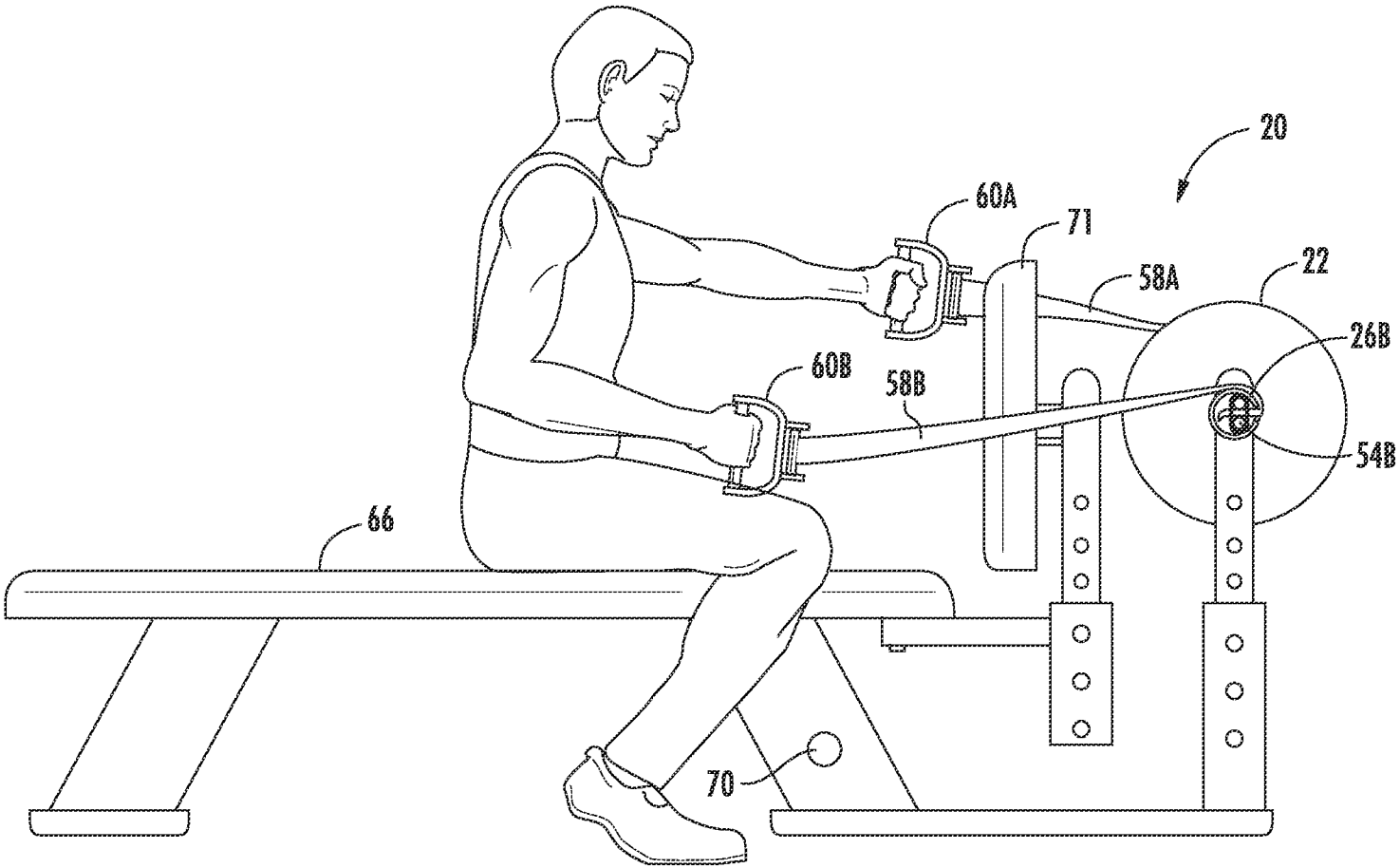
FIGS. 7A and 7B show a schematic side view of a user engaging an exemplary exercise apparatus as described herein.
Figure 7B:
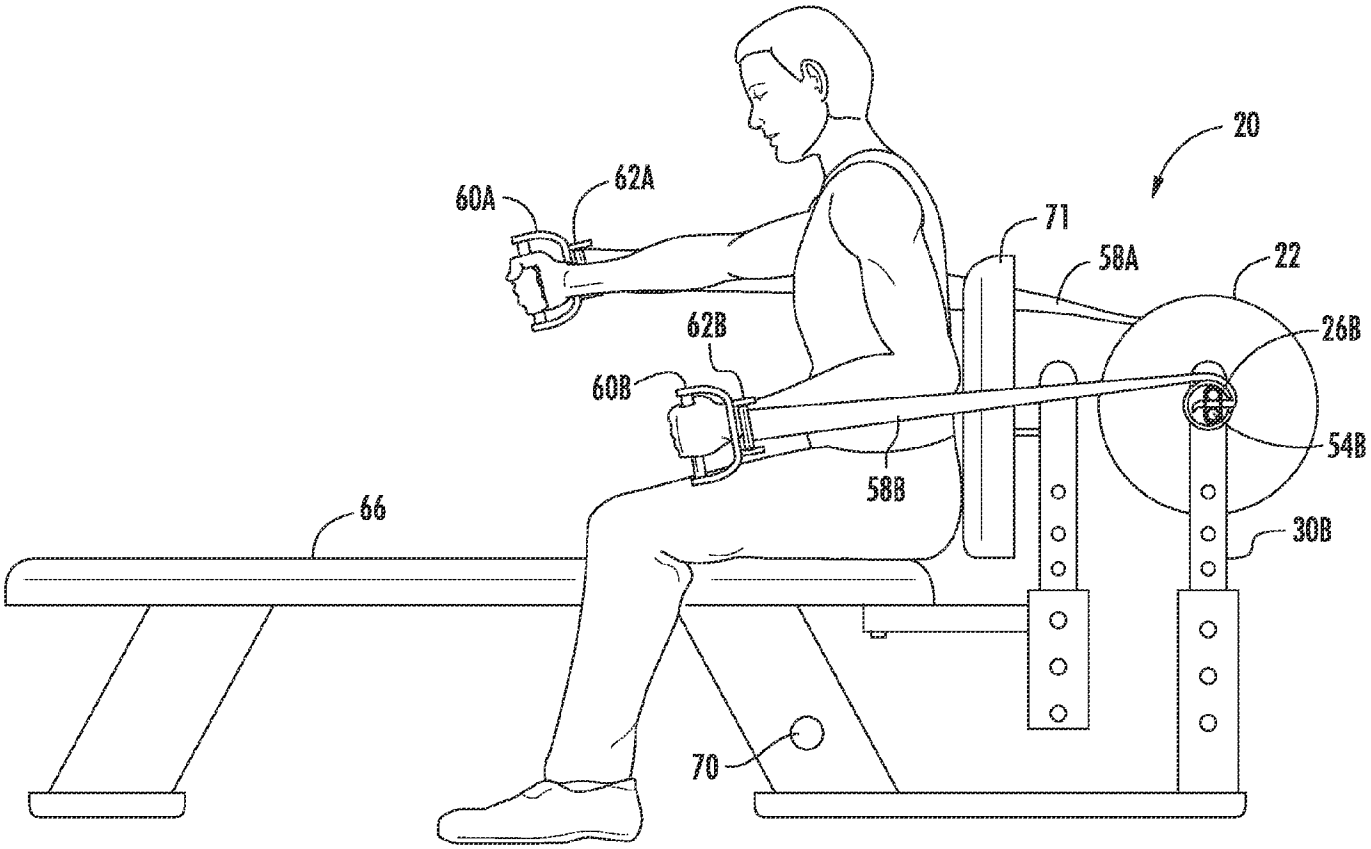

FIG. 7A shows, for example, a user performing a sitting horizontal lat pull exercise with resistance coming directly from the engagement members 26. FIG. 7B shows a user performing a sitting chest press exercise with resistance coming directly from the engagement members 26. Preferably, an adjustable backrest 71 is provided as shown in FIGS. 7A and 7B.

Figure 8:
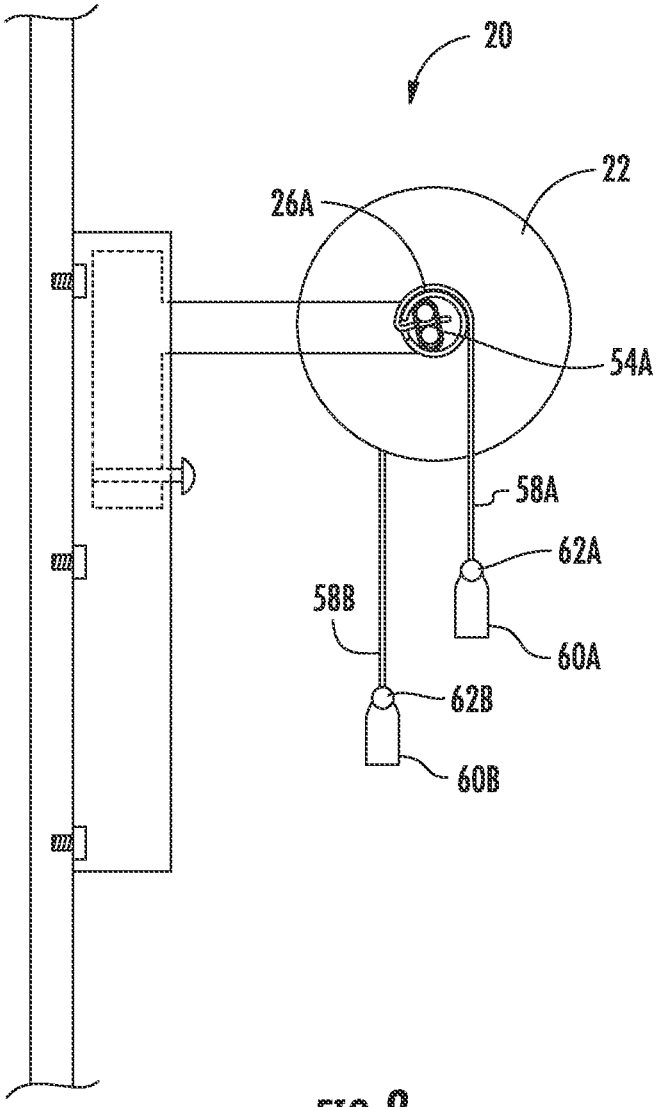
FIG. 8 shows a schematic side view of an exemplary exercise device as described herein.

In another example shown in FIG. 8, the resistance apparatus 20 is connected to a wall, preferably along a height selective apparatus so that a user can raise or lower the resistance apparatus 20 based on the type of exercise the user desires to conduct.

Figure 9:
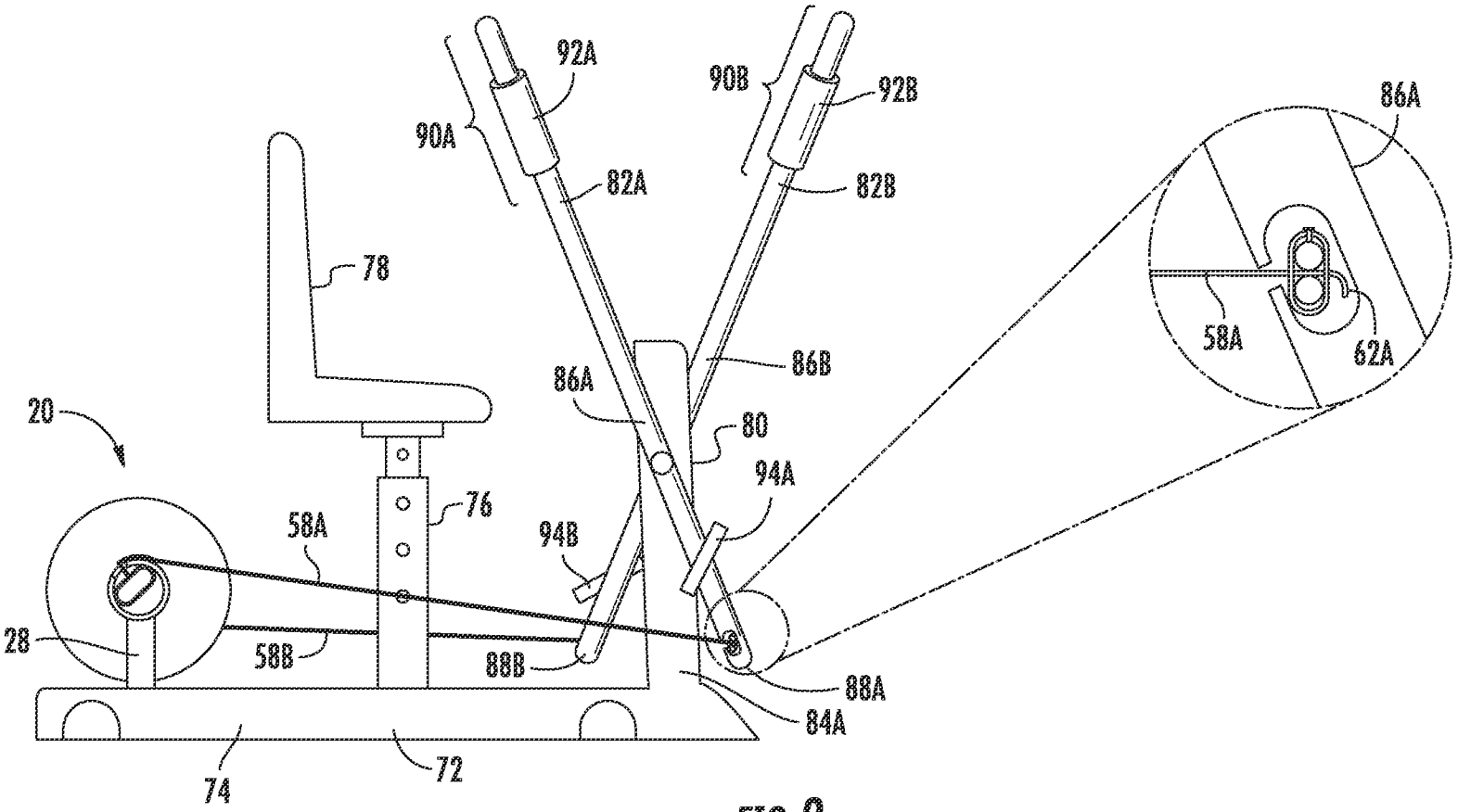
FIG. 9 shows a schematic side view of an exemplary exercise device as described herein.
Figure 10:
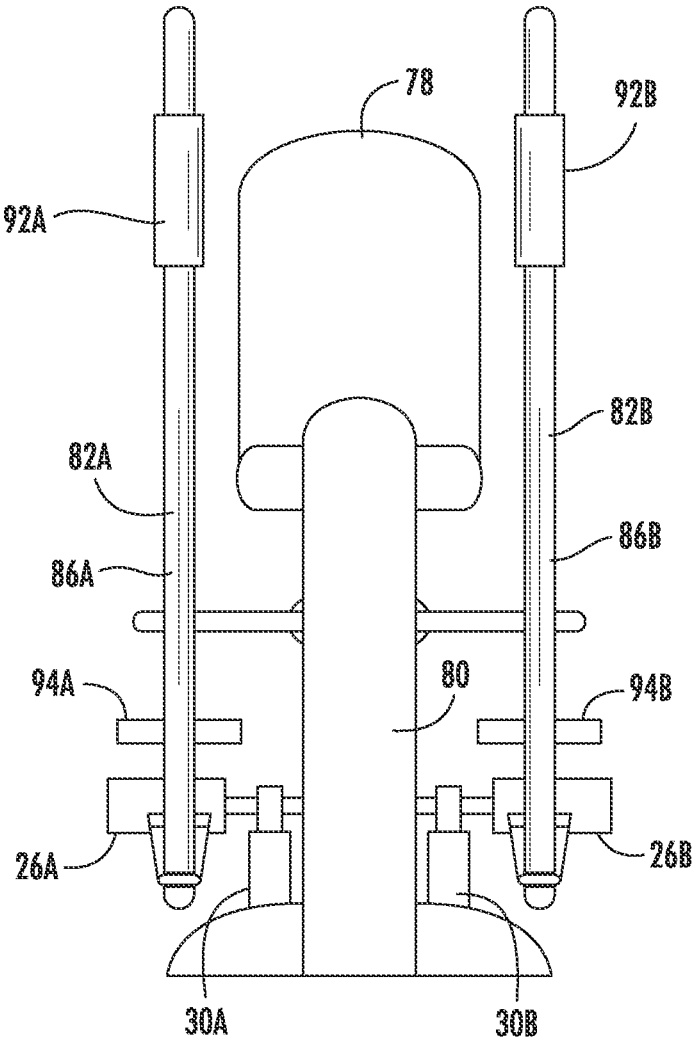
FIG. 10 shows a schematic front view of an exemplary exercise device as described herein.

In yet another example shown in FIGS. 9-10, the resistance apparatus 20 is connected to a central structure 72 that includes a base 74, a seat support 76 connected to the base 74, a seat 78 connected to the seat support 76, and a first vertical column 80 connected to the base 74. A first arm 82A (e.g., a substantially linear rod) is movably connected to a first side 84A of the column 80 along a central portion 86A of the first arm 82A, and a second arm 82B is movably connected to a second side 84B of the column 80 along a central portion 86B of the second arm 82B. These connections are preferably pivotal connections wherein the arms 82 are able to rotate in substantially parallel planes. Various mechanical ways of connecting the arms 82 to the vertical column 80 known to persons having ordinary skill in the art are contemplated herein including, for example, using a slip ring on either side of the column 80, or, for example, extending horizontal bars out from the column 80 about which the arms 82 can rotate via a mechanical bearing. The frame 28 is connected to or otherwise forms part of the central structure 72 and the first cord 58A is preferably substantially aligned (planar) with the first arm 82A and the second cord 58B is preferably substantially aligned (planar) with the second arm 82B as shown from an end view in FIG. 10. The proximal end 62A of the first cord 58A is connected proximate a lower end 88A of the first arm 82A, and the proximal end 62B of the second cord 58B is connected proximate a lower end 88B of the second arm 82B. The cords 58 can be connected to the arms 82 in various ways known to persons skilled in the art, but one example is shown as a close-up in FIG. 9. Based on the multiple connections of the cords 58, a user sitting on the seat 78 experiences increased resistance when the user pulls along an upper portion 90 (90A and 90B) of one of the arms 82. Preferably, a first hand grip 92A is connected along the upper portion 90A of the first arm 82A, and second hand grip 92B is connected along the upper portion 90B of the second arm 82B.

The example shown in FIGS. 9-10 also shows arms 82 wherein the first arm 82A further includes a first foot platform 94A connected at a location along a lower portion of the first arm 82A, and the second arm 82B includes a second foot platform 94B connected at a location along a lower portion of the second arm 82B. The foot platforms 94 can be used by a user to rest the user's feet and/or to engage the user's legs in resistance exercise wherein a user experience resistance when a user's leg pushes a foot platform 94 away from the user.

In other examples, the resistance apparatus 20 is configured to provide resistance for various other exercises. For example, the resistance apparatus may be configured for leg curl and leg extension exercises. Additionally, the resistance apparatus 20 is positionable in various locations, such as behind a user, in front of a user, above a user, and below a user to accommodate various methods of resistance exercise.

Figure 11:
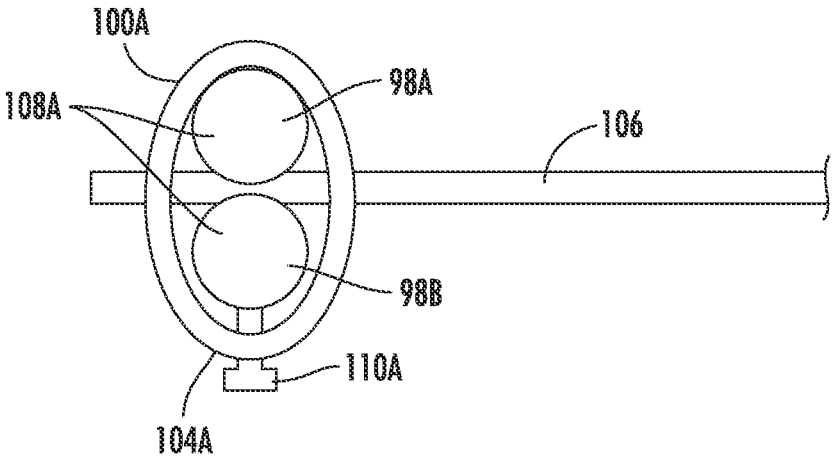
FIG. 11 shows a schematic side view of an exemplary clamping device as described herein.
Figure 12:
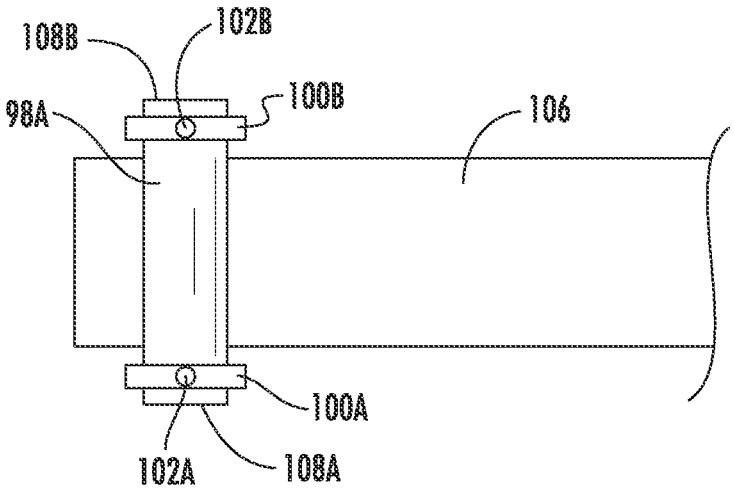
FIG. 12 shows a schematic top view of an exemplary clamping device as described herein.

Elastic bands have been shown to work particularly well for various uses of the resistance apparatus 20, but one difficult problem to overcome was how to efficiently and securely connected a stopper 54 to the bands. One solution, shown in FIGS. 11-12, includes a pair of elongate slugs 98 (98A and 98B), a pair of ovular-shaped rings 100 (a first ring 100A and a second ring 100B), each ring 100 including a threaded aperture 102 (a first threaded aperture 102A and a second threaded aperture 102B) located along a narrower end 104 (104A and 104B) of each ring 100. The slugs 98 are laid parallel across opposing sides of an elastic band 106. The slugs 98 are long enough so that the ends of each slug protrude beyond the edges of the band 106, allowing enough space for the first ring 100A to be placed about a first pair of slug ends 108A and the second ring 100B to placed about a second pair of slug ends 108B. A first tightening screw 110A and a second tightening screw 110B are rotated in and through the first threaded aperture and the second threaded aperture, respectively, in order to tighten the grip of the slugs on the band 106.

Figure 13:
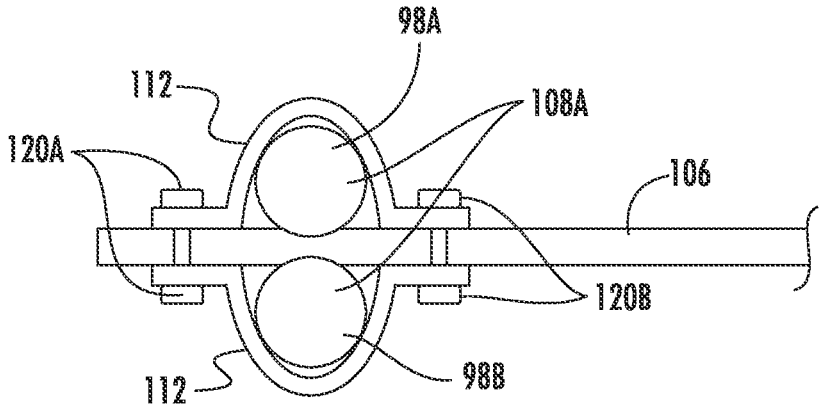
FIG. 13 shows a schematic side view of an exemplary clamping device as described herein.
Figure 14:
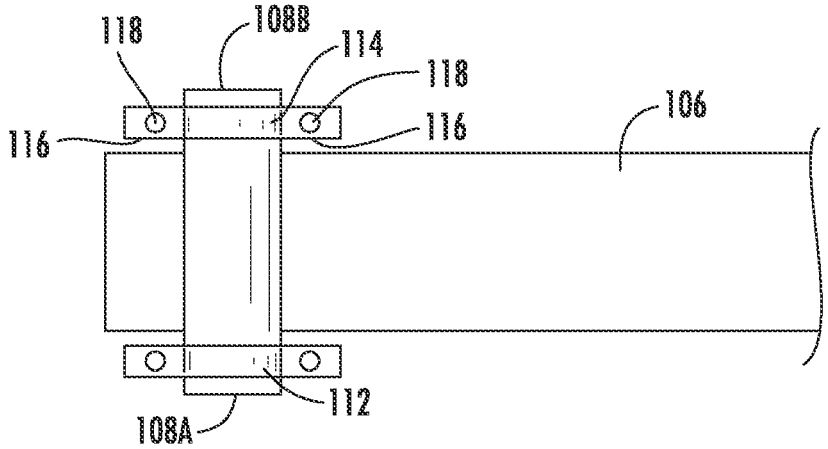
FIG. 14 shows a schematic top view of an exemplary clamping device as described herein.

As shown in FIGS. 13-14, another example of a stopper 54 that can be efficiently and securely connected at various locations along the exemplary band 106 includes the elongate slugs 98, a first pair of mirrored clamps 112 and a second pair of mirrored clamps 114, each pair of clamps including flanges 116 through which at least one aperture 118 is located. The first pair of clamps 112 are placed about a first pair of slug ends 108A and the second pair of clamps 114 are placed about a second pair of slug ends 108B. The first pair of clamps 112 can be tightened together by a pair of tightening fasteners 120 (120A and 120B) situated through the apertures 118 in each flange 116. Examples of tightening fasteners 120 include a pair of nuts and bolts, a pair of screws, a pair of threaded bolts (for examples in which the apertures 118 are threaded), and similar fastening devices known to a person having ordinary skill in the art.

The previously described embodiments of the present disclosure have many advantages, including providing a compact, flexible apparatus that can be used to provide resistance for various exercises including weight training exercises, cardio-vascular exercises, and combinations thereof. The reciprocal movements employed by a user of the resistance apparatus 20 allows such user to effectively control the magnitude of added resistance caused by the temporal momentum of the weighted object 22 by increasing or decreasing the force in which the user engages the apparatus 20. The resistance apparatus 20 can be used for pulling exercises and pushing exercises at various angles of attack, and the resistance apparatus 20 can replace or supplement prior existing resistance features on exercise equipment (e.g., stationary bicycles, elliptical machines). Various types of exercise apparatuses that include the resistance apparatus 20 provide variable and alternating eccentric/concentric contraction of a target muscle group as well as extensive co-contraction of the core, hips and leg muscles as stabilizers during such exercises. For examples in which elastic bands are used as cords, the resistance apparatus 20 provides more efficient neural firing gains due to the variability of the resistance within each rep of a given exercise. This upward neural input creates agility within a particular target muscle and among the network of muscles involved in stabilizing a user's body during an exercise routine.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A resistance apparatus for a resistance exercise device, the resistance apparatus comprising:

a. a weighted object including an aperture located through the center of the weighted object wherein the aperture includes a first cross-sectional shape;

b. an elongate beam including the first cross-sectional shape wherein the beam extends in and through the aperture of the weighted object, wherein the weighted object is engaged with the beam so that when the beam rotates about its lengthwise axis, the weighted object rotates with the beam at substantially the same rotational speed as the beam along the same axis;

c. a first engagement member wherein a proximal end of the first engagement member is connected to a first end of the beam, the first engagement member including a cavity defined from a distal end of the first engagement member, and a slot extending from the distal end of the first engagement member along a portion of an outer edge of the first engagement member;

d. a second engagement member wherein a proximal end of the second engagement member is connected to a second end of the beam, the second engagement member including a cavity defined from a distal end of the second engagement member, and a slot extending from the distal end of the second engagement member along a portion of an outer edge of the second engagement member;

e. a frame including a first support extension and a second support extension wherein the first support extension is connected to the second support extension defining a space between the first support extension and the second support extension;

f. a first bearing connected to a proximal end of the first support extension wherein a first portion of the beam located between the first engagement member and the weighted member is maintained within the first bearing, wherein the beam is free to rotate along its lengthwise axis within the first bearing; and g. a second bearing connected to a proximal end of the second support extension wherein a second portion of the beam located between the second engagement member and the weighted member is maintained within the second bearing, wherein the beam is free to rotate along its lengthwise axis within the first bearing, wherein the weighted member extends at least partially into the space between the first support extension and the second support extension.

2. The resistance apparatus of claim 1 wherein the first cross-sectional shape comprises a polygonal shape including from one substantially straight side to sixteen substantially straight sides.

3. The resistance apparatus of claim 1 wherein the first cross-sectional shape comprises at least one curved side.

4. The resistance apparatus of claim 1 wherein the first engagement member further comprises a first engagement member port for receiving the first end of the beam and removably engaging with the beam such that the first engagement member rotates at substantially the same speed as the beam when the beam is rotated along its lengthwise axis, and wherein the second engagement member further comprises a second engagement member port for receiving the second end of the beam and removably engaging with the beam such that the second engagement member rotates at substantially the same speed as the beam when the beam is rotated along its lengthwise axis.

5. The resistance apparatus of claim 1 wherein the first bearing comprises a plain bearing and wherein the second bearing comprises a plain bearing.

6. The resistance apparatus of claim 1 wherein the first bearing comprises a rolling element bearing and wherein the second bearing comprises a rolling element bearing, wherein each rolling element bearing includes an inner ring including an aperture configured in the first cross-sectional shape and sized to fit snug about the beam but still allowing the beam to be moved in and out the inner ring aperture as needed.

7. The resistance apparatus of claim 1 further comprising a pair of shaft collars for maintaining the weighted object between the pair of collars along a central lengthwise portion of the beam, each shaft collar comprising a tightening mechanism to hold the shaft collar in place along the beam.

8. The resistance apparatus of claim 1 further comprising:

a. a first elastic band, a first handle connected to a proximal end of the first elastic band, and a first stopper connected proximate a distal end of the first elastic band, wherein the first stopper is configured for removable insertion within the cavity defined from a distal end of the first engagement member wherein the first elastic band extends out through the slot of the first engagement member but the size of the first stopper keeps the first stopper from escaping through the slot of the first engagement member, thereby maintaining a connection between the first elastic band and the first engagement member;

b. a second elastic band, a second handle connected to a proximal end of the second elastic band, and a second stopper connected proximate a distal end of the second elastic band, wherein the second stopper is configured for removable insertion within the cavity defined from a distal end of the second engagement member wherein the second elastic band extends out through the slot of the second engagement member but the size of the second stopper keeps the second stopper from escaping through the slot of the second engagement member, thereby maintaining a connection between the second elastic band and the second engagement member.

9. The resistance apparatus of claim 1 wherein the weighted object further comprises a wheel.

10. The resistance apparatus of claim 1 further comprising a first cord and a first stopper connected proximate a distal end of the first cord, wherein the first stopper is configured for removable insertion within the cavity defined from a distal end of the first engagement member wherein the first cord extends out through the slot of the first engagement member but the size of the first stopper prevents the first stopper from escaping through the slot of the first engagement member, thereby maintaining a connection between the first cord and the first engagement member.

11. The resistance apparatus of claim 9, wherein the frame further comprises a base on which the resistancce apparatus is supported.

12. The resistance apparatus of claim 9 and further comprising an exercise bench including a support platform and a plurality of legs connected to the support platform, wherein the frame is connected to the exercise bench proximate a first end of the exercise bench.

13. The resistance apparatus of claim 12 wherein the weighted object is located beneath the support platform.

14. The resistance apparatus of claim 12 further comprising a backrest plate connected to the support platform proximate the first end of the exercise bench.

15. The resistance apparatus of claim 10 further comprising:

a. a central structure including a base, a seat support connected to the base, a seat connected to the seat support, a first vertical column connected to the base adjacent a first side of the base, and a second vertical column attached to the base adjacent a second side of the base;

b. a first arm movably connected to the first column;

c. a second arm movably connected to the second column; and d. the frame connected to the central structure, wherein a proximal end of the first cord is connected proximate a lower end of the first arm and a proximal end of the second cord is connected proximate a lower end of the second arm, wherein tension along the first cord is generated when a user sitting on the seat pulls an upper portion of the first arm toward the user and wherein tension along the second cord is generated when a user sitting on the seat pulls an upper portion of the second arm toward the user.

16. The resistance apparatus of claim 14 wherein the first arm further comprises a first handgrip connected along the upper portion of the first arm; and wherein the second arm further comprises a handgrip connected along the upper portion of the second arm.

17. The resistance apparatus of claim 15 further comprising a first foot platform connected proximate to a lower end of the first column and a second foot platform connected proximate to a lower end of the second column, wherein tension along the first cord is generated when a user sitting on the seat pushes the first foot platform away from the user and wherein tension along the second cord is generated when a user sitting on the seat pushes the second foot platform away from the user.

* * * * *